US008924207B2

(12) United States Patent
Mansour

(10) Patent No.: US 8,924,207 B2
(45) Date of Patent: Dec. 30, 2014

(54) METHOD AND APPARATUS FOR TRANSCODING AUDIO DATA

(75) Inventor: Mohamed Farouk Mansour, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 673 days.

(21) Appl. No.: 12/840,022

(22) Filed: Jul. 20, 2010

(65) Prior Publication Data

US 2011/0022398 A1 Jan. 27, 2011

Related U.S. Application Data

(60) Provisional application No. 61/228,056, filed on Jul. 23, 2009.

(51) Int. Cl.

| | |
|---|---|
| ***G10L 21/00*** | (2013.01) |
| ***G10L 25/90*** | (2013.01) |
| ***G10L 25/93*** | (2013.01) |
| ***G10L 21/02*** | (2013.01) |
| ***G10L 19/02*** | (2013.01) |
| ***G10L 19/00*** | (2013.01) |
| ***G10L 19/16*** | (2013.01) |
| *G10L 19/008* | (2013.01) |

(52) U.S. Cl.

CPC ..... *G10L 19/173* (2013.01); *G10L 19/008* (2013.01)

USPC ..... 704/228; 704/205; 704/206; 704/215; 704/226; 704/229; 704/230

(58) Field of Classification Search

CPC ..... G10L 19/18; G10L 19/22; G10L 19/24; G10L 19/173

USPC ..... 704/205, 206, 226, 228, 229–230, 215

See application file for complete search history.

(56) References Cited

U.S. PATENT DOCUMENTS

| | | | | |
|---|---|---|---|---|
| 5,657,418 | A * | 8/1997 | Gerson et al. | 704/207 |
| 5,862,178 | A * | 1/1999 | Jarvinen et al. | 375/240 |
| 5,864,802 | A * | 1/1999 | Kim et al. | 704/230 |
| 6,041,295 | A * | 3/2000 | Hinderks | 704/206 |
| 6,233,162 | B1 * | 5/2001 | Pistemaa et al. | 363/21.13 |
| 6,556,966 | B1 * | 4/2003 | Gao | 704/220 |
| 6,934,677 | B2 * | 8/2005 | Chen et al. | 704/200.1 |
| 7,240,001 | B2 * | 7/2007 | Chen et al. | 704/230 |
| 7,433,824 | B2 * | 10/2008 | Mehrotra et al. | 704/501 |
| 7,724,324 | B2 * | 5/2010 | Chae et al. | 349/106 |
| 7,877,253 | B2 * | 1/2011 | Krishnan et al. | 704/225 |

OTHER PUBLICATIONS

"Digital Audio Compression Standard (AC-3, E-AC-3) Revision B", Document A/52B, Advanced Television Systems Committee, 2005.

(Continued)

*Primary Examiner* — Eric Yen

(74) *Attorney, Agent, or Firm* — Mima Abyad; W. James Brady; Frederick J. Telecky, Jr.

(57) ABSTRACT

A method and apparatus for transcoding audio data. The method includes determining if AAC joint stereo exists, running a reference AC-3 rematrixing when the AAC joint stereo does not exist, when AAC joint stereo does exist, enabling rematrixing when the number of corresponding AAC bands is greater than half the size of the band, otherwise, running reference AC-3 rematrixing.

15 Claims, 5 Drawing Sheets

(56) References Cited

OTHER PUBLICATIONS

ISO/IEC 14496-3, Information technology—Coding of audio-visual objects—Part 3: Audio, 1999.
J. Johnston and A. Ferreira, "Sum-difference stereo transform coding", IEEE Int. Conf. on Acoustics, Speech, and Signal Processing, ICASSP, vol. 2 pp. 569-572,1992.
H. Malvar, "Lapped transforms for efficient transform/subband coding", IEEE Transaction on Acoustics, Speech and Signal Processing, vol. 38, No. 6, pp. 969-978, Jun. 1990.
Mohamed F. Mansour, "Strategies for bit allocation reuse in audio trancoding," IEEE International Conference on Acoustics, Speech and Siganl Processing, ICASSP, pp. 157-160, 2009.
M. Mansour, "A matrix approach for the transcoding of modulated lapped transforms", to be submitted to IEEE International Conference on Acoustics, Speech and Signal Processing, ICASSP, 2010.
B. Moore, "Introduction to the psychology of hearing", Academic Press 4th ed., 1997, pp. 65-69, 92-97, 100-116.
A. Lerch, EAQUAL Evaluation of Audio Quality: http://www.mp3-tech.org/programmer/sources/eaqual.tgz. (10 pages).
ITU-R Rec. BS. 1387 "Method for Objective Measurements of Perceived Audio Quality", International Telecommunicatios Union, 1998.
EBU-SQAM—Sound Quality Assessment Material—Recordings for subjective Tests, Cat. No. 422 204-2.

* cited by examiner

METHOD AND APPARATUS FOR TRANSCODING AUDIO DATA

CROSS-REFERENCE TO RELATED APPLICATIONS

This application claims benefit of U.S. provisional patent application Ser. No. 61/228,056, filed Jul. 23, 2009, which is herein incorporated by reference.

BACKGROUND OF THE INVENTION

1. Field of the Invention

Embodiments of the present invention generally relate to a method and apparatus for transcoding audio data.

2. Description of the Related Art

The progress in audio coding algorithms and the widespread of digital media distribution pushed the efforts to standardize formats for audio distribution. Many audio standards in the last two decades have been proposed and successfully deployed in different applications platforms. Among these noticeable standards are the MPEG-1 audio standard for audio file storage, MPEG-2 and MPEG-4 audio standards for broadcasting and networking, and the Dolby standards for TV broadcasting.

In many application scenarios, transcoding between two different audio standards is needed. For example, satellite broadcasting in the united states uses MPEG-2 audio standards at 256 kbps, and the DVD recoding uses Dolby digital standard for audio storage at a similar bitrate. The straightforward audio transcoder uses a tandem realization of an audio decoder for the first system followed by an audio encoder for the second system. Typically the two components in the tandem realization are completely independent. However, most audio standards use subband coding schemes with similar architecture. Therefore, the decoder information can be exploited to reduce the complexity of the audio encoder.

Therefore, there is a need for a method and/or apparatus for improving the transcoding of audio data.

SUMMARY OF THE INVENTION

Embodiments of the present invention relate to a method and apparatus for transcoding audio data The method includes determining if AAC joint stereo exists, running a reference AC-3 rematrixing when the AAC joint stereo does not exist, when AAC joint stereo does exist, enabling rematrixing when the number of corresponding AAC bands is greater than half the size of the band, otherwise, running reference AC-3 rematrixing.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Employing the information available at the decoder part of the transcoder, one may exploit the similarity in standard audio coders to simplify the implementation of the encoder part of the transcoder. The transcoder under study is from AAC standard to AC-3 standard. However, the proposed algorithms can be easily extended to other transcoding schemes. I For example similar procedure could be used for transcoding from MPEG-1 layer 2 standard to AC-3 standard, or from AC-3 standard to AAC standard.

Figure 1:
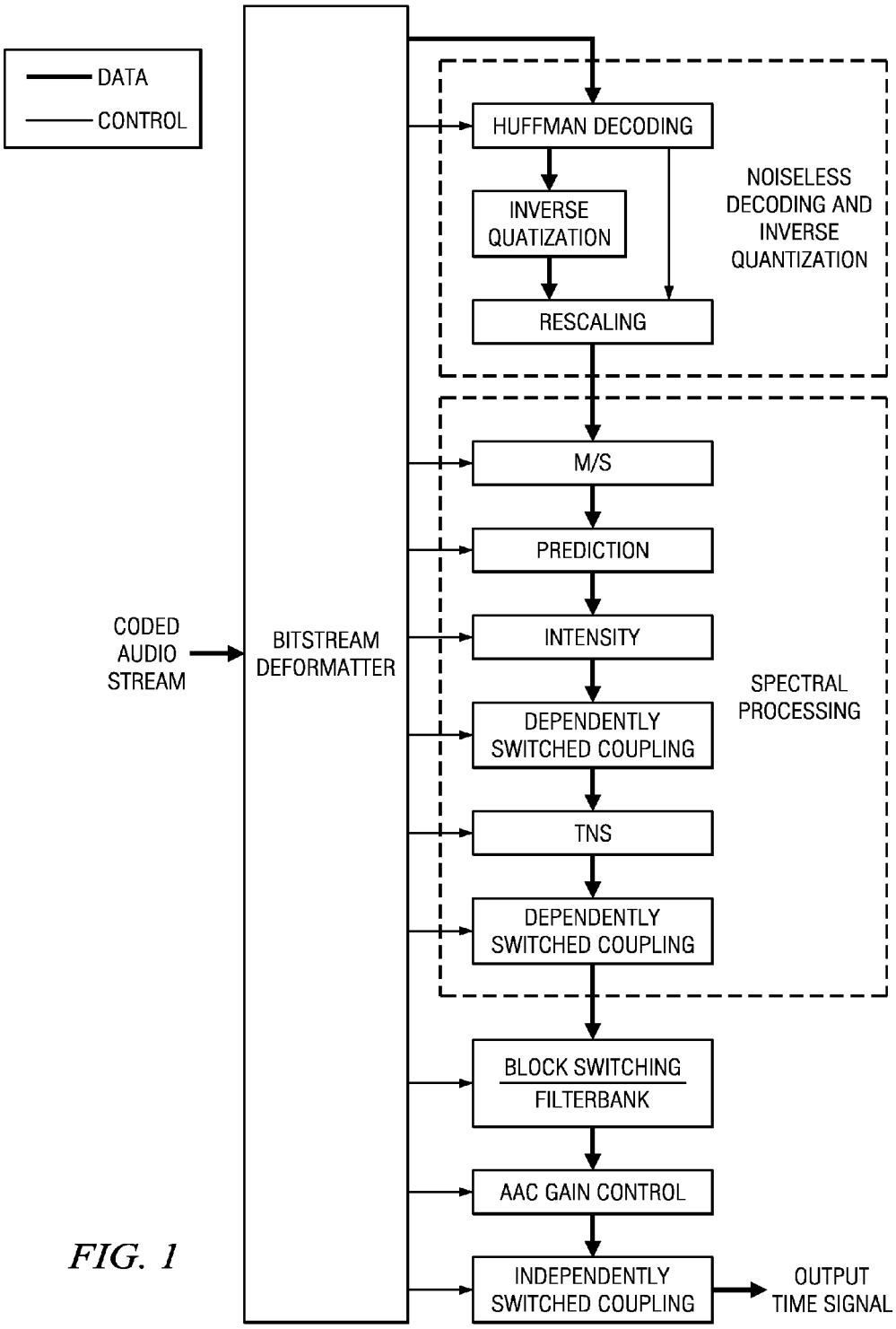
FIG. 1 is an embodiment of an AAC decoder.

FIG. 1 is an embodiment of an AAC decoder. The standard AAC decoder is as shown in FIG. 1. It follows the main theme of generic subband coders. The quantization redundancy is reduced by using Huffman coding. Some extra modules for preprocessing the spectrum prior to quantization are included, e.g., joint stereo coding, temporal noise shaping (TNS), and long term prediction (LTP).

The AAC codec uses a block switching mechanism to reduce the effect of pre-echoes in case of transients. A long block is used for stationary parts of the signal and it uses a 1024-channel filter bank. A short block is used for transients, and it uses a 128-channel filter bank. The coder uses special transition windows to switch back and forth between long and short blocks without violating the perfect reconstruction condition.

Figure 2:
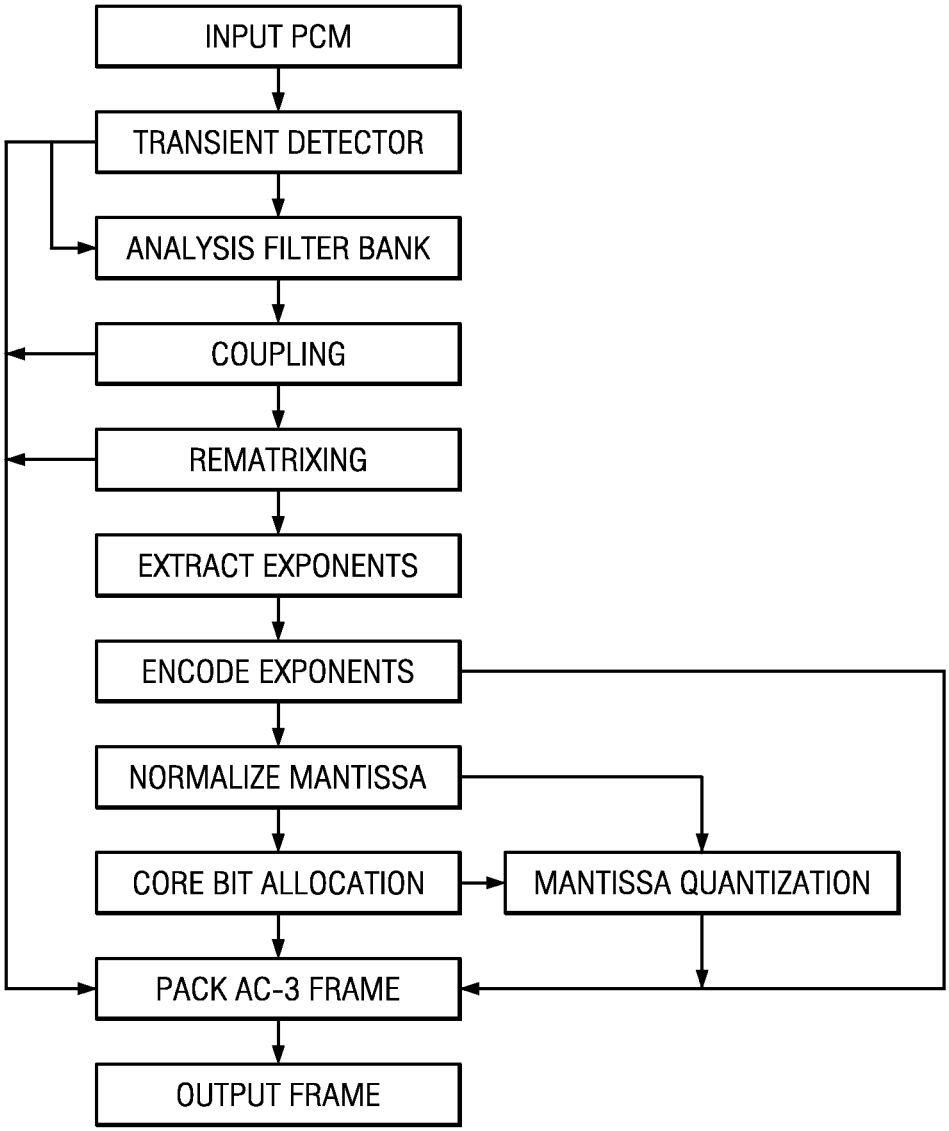
FIG. 2 is an embodiment of an AC-3 encoder.

FIG. 2 is an embodiment of an AC-3 encoder. The AC-3 standard is another example of subband coding. A block diagram of the encoder is shown in FIG. 2. The AC-3 also uses a block switching mechanism, where a long window has 256 channels and a short block has 128 channels. Unlike the AAC codec, the AC-3 usually does not employ transition windows between the short and long blocks. Rather, a specially designed long window is split to halves and used for two blocks of short windows. The block switching decision is done in the transient detector which examines the existence of transient in the current block.

The rematrixing block in the AC-3 encoder resembles the joint stereo coding block in the AAC codec. The quantization procedures are relatively similar, and yield similar results. The block switching mechanisms are similar. Thus, herein, the invention describes an embodiment of an efficient implementation for converting MPEG-2/MPEG-4 Advanced Audio Coding (AAC) encoded data to Dolby Digital AC-3 encoded data. Many techniques may be utilized to exploit the information in the AAC bitstream to simplify the AC-3 encoder. These techniques can be straightforwardly used in other transcoding schemes.

The straightforward implementation of the audio transcoder would be a tandem of the AAC decoder followed by a completely independent AC-3 encoder. Although the tandem realization has the advantage of modular design where usually both decoder and encoder are available as stand-alone blocks, it may not exploit the information already available from the first codec. Usually, different audio coders make similar decisions on the same audio data. Therefore, it is beneficial to exploit the decisions already made by the first codec to simplify the design of the second encoder. The optimization of the different encoder modules may be described based on the information available from the first codec. Although this discussion is for our particular example of AAC/AC-3 transcoder, it is well applicable to other pairs of transform coders.

Both AAC and AC-3 use perfect reconstruction cosine-modulated filter banks with the window size equals twice the number of channels. It is also called modulated lapped transform (MLT). The AAC filter bank may have 1024 channel in long blocks and 128 channels in short blocks. The AC-3 filter bank may have 256 channels in long blocks and 128 channels in short blocks. They both use symmetrical windows for the MDCT. The delay of both filter banks is half the window size. Therefore, the overall delay of the AAC analysis and synthesis filter banks is 2048 samples (in case of long blocks), and the combined delay of the AAC synthesis filter bank and the AC-3 analysis filter bank is 1280 samples. The AAC frame size is 1024, whereas the AC-3 frame size is 1536 (it contains six subframes each of size 256). Therefore, every two AC-3 frames encompasses three AAC frames. For stationary parts of the audio signal, i.e., when long blocks are used for both coders, the properties of an AAC frame may be mapped to the corresponding AC-3 frame after compensating for the 1280 samples delay.

For the stationary part of the signal, one may use a straightforward frequency mapping where each four AAC subbands correspond to one AC-3 subband. This mapping is used in deriving the bit allocation information of the AC-3 spectral coefficients.

The tandem implementation of the filter banks may implement the MDCT of the AAC decoder followed by the IMDCT of the AC-3 encoder. The size of the filter bank may depend on the block type. A generic filter bank transcoder for rational sizes of the filter banks and the implementation for the AAC/AC-3 filter bank transcoder case are described.

Assuming that both coders use long window, then the AAC filter bank would have 1024 channels and the AC-3 filter bank would have 256 channels. To describe the hybrid filter bank transfer function, the following definitions/notations are used:

J denotes the reverse diagonal matrix.

If D is a diagonal matrix then $\tilde{D}$ diagonal matrix whose entries are the reverse of D.

$D_a$ is a diagonal matrix whose entries are the first half (256 samples) of the AC-3 analysis window.

$D_s^{(k)}$ is a diagonal matrix of size 128 whose entries are the $k^{th}$ segment (of size 128) of the AAC synthesis window.

Thus, $$U_k = D_a D_s^{(k)} = \begin{pmatrix} U_k^{(1)} & 0 \\ 0 & U_k^{(2)} \end{pmatrix}$$

$$V_k = D_a \tilde{D}_s^{(k)} = \begin{pmatrix} V_k^{(1)} & 0 \\ 0 & V_k^{(2)} \end{pmatrix}$$

Note that these are diagonal matrices of size 128. Using such a technique, then the hybrid filter bank can be put in matrix form as:

$$\Lambda = \begin{pmatrix} C_a & 0 & 0 & 0 \\ 0 & C_a & 0 & 0 \\ 0 & 0 & C_a & 0 \\ 0 & 0 & 0 & C_a \end{pmatrix} .G.C_s$$

Where $$G = \begin{pmatrix} 0 & 0 & z^{-1}\tilde{U}_4^{(1)}J & z^{-1}U_4^{(2)} & V_1^{(2)}J & \tilde{V}_1^{(1)} & 0 & 0 \\ 0 & 0 & -z^{-2}V_1^{(1)} & z^{-2}\tilde{V}_1^{(2)}J & z^{-1}\tilde{U}_4^{(2)} & -z^{-1}U_4^{(1)}J & 0 & 0 \\ z^{-1}\tilde{U}_3^{(2)}J & z^{-1}U_3^{(1)} & 0 & 0 & 0 & 0 & -V_2^{(2)}J & -\tilde{V}_2^{(1)} \\ 0 & 0 & z^{-1}\tilde{V}_4^{(2)} & -z^{-1}V_4^{(1)}J & U_1^{(1)} & -\tilde{U}_1^{(2)}J & 0 & 0 \\ z^{-1}U_2^{(2)}J & z^{-1}\tilde{U}_2^{(1)} & 0 & 0 & 0 & 0 & \tilde{V}_3^{(1)}J & V_3^{(2)} \\ 0 & 0 & z^{-1}\tilde{V}_3^{(2)} & -z^{-1}V_3^{(1)}J & 0 & 0 & U_2^{(1)} & -\tilde{U}_2^{(2)}J \\ 0 & 0 & z^{-1}U_1^{(2)}J & z^{-1}\tilde{U}_1^{(1)} & \tilde{V}_4^{(2)}J & V_4^{(1)} & 0 & 0 \\ -z^{-1}V_2^{(1)} & z^{-1}\tilde{V}_2^{(1)}J & 0 & 0 & 0 & 0 & \tilde{U}_3^{(2)} & U_3^{(1)}J \end{pmatrix}$$

and $C_a$ is the DCT-IV matrix of size 256, and $C_s$ is the DCT-IV matrix of size 1024, i.e., $$C_a(i,j)=\cos(\pi(i+0.5)(j+0.5)/256)$$

$$C_s(i,j)=\cos(\pi(i+0.5)(j+0.5)/1024)$$

Each block in G is of size 128×128. Note that in this implementation, one may not explicitly compute the MDCT/IMDCT. Rather, the DCT-IV may be used and the post-processing of the MDCT and the preprocessing of the IMDCT may be combined along with the windowing parts in both filter banks to get this formula.

The RAM requirement (for storing intermediate spectral values) for the windowing part of the proposed structure is 1664 words rather than 2560 words in the tandem implementation. The ROM requirement (for storing the matrix entries) is 1024 words rather than 1280 words in the tandem implementation. One may have a total of 4096 multiplications, which is the same as the tandem implementation. However, the proposed topology provides significant reduction in the reordering complexity in the IMDCT/MDCT which consumes considerable cycles if implemented on a general purpose processor.

This procedure is used only in case of long windows in both the AAC and AC-3 coders (which accounts for most blocks in common audio signals). When a block switch is invoked in either coder, then the tandem implementation is used and the DCT-IV coefficients is mapped back to the MDCT/IMDCT domain.

Both AAC and AC-3 use a block-switching mechanism to mitigate pre-echoes in case of transients. The pre-echo is a known phenomenon where the frame exhibit a high energy audio segment after a silence period. In this case the quantization noise floor (which is almost uniform across the frame) is most noticeable in the low energy period. In this case, the coder switches to short windows that offer higher time resolution at the expense of less frequency resolution. The transition is instantaneous for the AC-3 encoder where the same window is used for two consecutive frames (each of size 128). The transition from long to short window in the AAC decoder requires specially designed transition window (called start window) to satisfy the perfect reconstruction condition. Similarly, the transition from short to long window requires another special window (called stop window). Since both the AAC and AC-3 decoder make the block switching decision on the same audio data, the block-switching information in the AAC bitstream can exploited to simplify the AC-3 transient detector.

The basic idea of the optimized AC-3 transient detector algorithm is to disable the standard AC-3 transient detector as long as the AAC decoder uses long windows. The detector is initialized once a start window block is used in the AAC decoder. The AC-3 transient detector is activated only at the subframes that correspond to short windows.

The transient detection algorithm itself (which is activated only during AAC short windows) can be further simplified. The standard AC-3 transient detector divides the AC-3 frame to subblocks, then it measures the energy of the different subblocks and based the transient decision on the relative energies between the subblocks. Most computations take place in energy computations. Since the AAC bitstream provides a more compact signal presentation in the spectral domain where most of the coefficients are zero, then the energy computation is significantly reduced if the energy computation is performed using AAC spectral coefficients. Recall that this procedure is run only during AAC short window periods, therefore it is run on windows of size 128. Denote the transition flag by flag, then the optimized transient detector algorithm proceeds as follows:

1) Set flag=0.
2) For the n-th AAC subframe (of size 128) compute the energy (denote it by $\zeta_n$). and the maximum absolute value of the spectral coefficients (denote it by $\eta_n$). Note that each AC-3 subframe corresponds to two AAC subframes.
3) If $\zeta_n \leq \delta$ (where $\delta$ represents the silence threshold), then end the procedure.
4) If $\zeta_n \geq \gamma_1 \zeta_{n-1}$ (where $\gamma_1$ is a threshold that is set to 10), then flag=1 and end the procedure.
5) If $\zeta_n \geq \gamma_2 \zeta_{n-1}$ (where $\gamma_2 = \gamma_1/2$) and $\eta_n \geq \beta \eta_{n-1}$ (where $\beta$ is a threshold that is set to 10), then flag=1.
6) If flag=0, then repeat the above four steps for the second AAC subframe within the current AC-3 frame.

Figure 3:
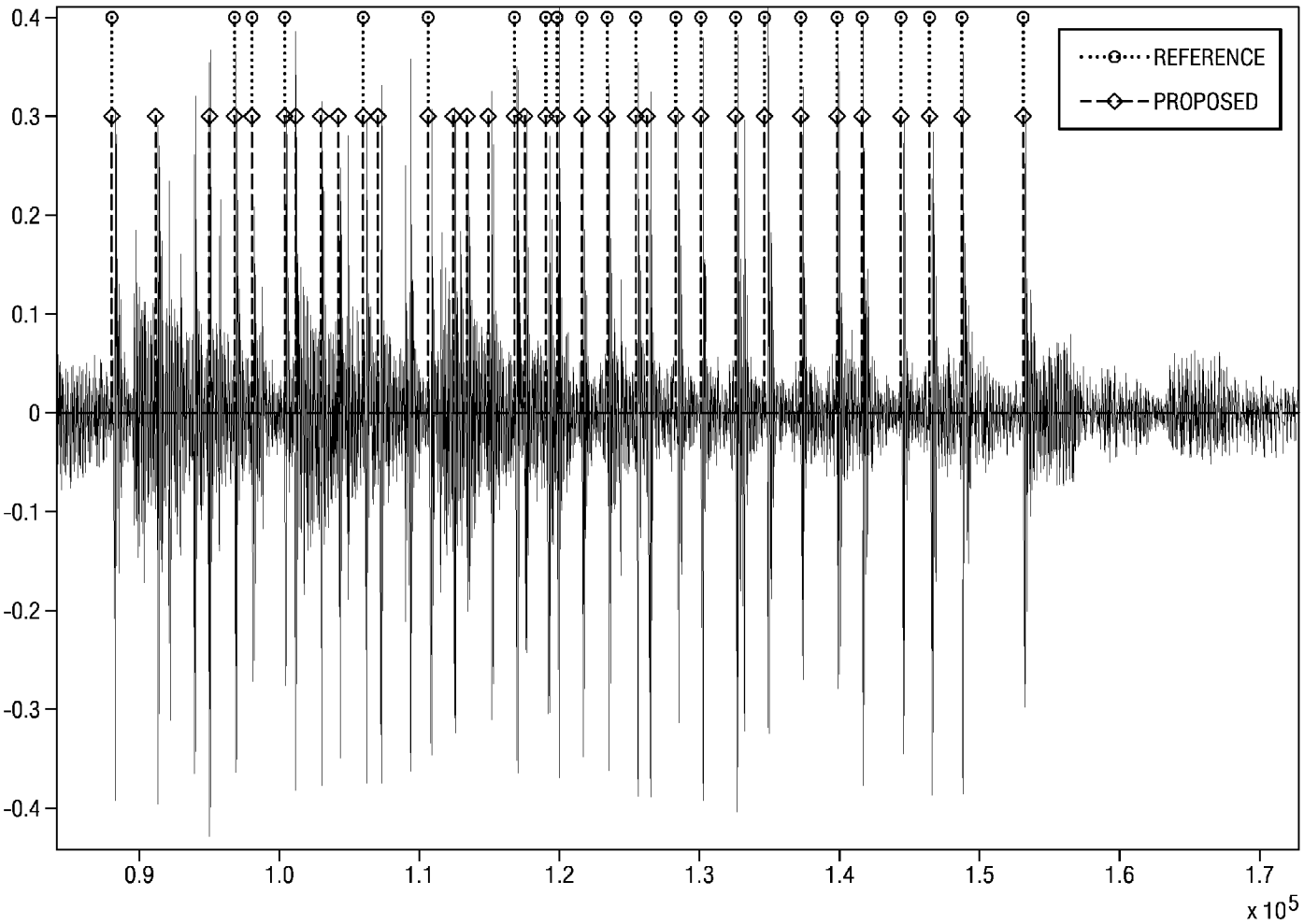
FIG. 3 is an embodiment of a transient detector in accordance with the current invention.

The energy and the maximum amplitude value in step (2) is computed over a subset of mid-frequency spectral coefficients to mitigate the possible effect of the high pass filtering that is usually incorporated as a preprocessor to the audio encoder. A typical plot of the algorithm performance for a file that exhibits frequent transients is illustrated in FIG. 3 along with the reference AC-3 algorithm where the vertical bars denote the existence of transients. FIG. 3 is an embodiment of a transient detector in accordance with the current invention. Note that, since the calculation is performed directly on the AAC spectral coefficients, then the transient decision is for future AC-3 subframes (after compensating for the AAC filter bank delay). If the AAC short window is used while AC-3 uses long blocks, then a weak transient flag is set. This flag is later used in deciding the AC-3 exponent strategy.

The rematrixing procedure in the AC-3 coder resembles the joint stereo coding in the AAC decoder. Therefore it is intuitive to exploit the AAC joint stereo information to simplify the rematrixing computing. Both AAC joint stereo coding and AC-3 rematrixing use sum/difference coding to reduce the overall bit allocation for stereo signal. Instead of encoding the left and right channels (L and R respectively) independently, the coder encodes the combinations L+R and L−R. If there exists a high correlation between the two channels then L+R will resemble the original channels whereas L−R has typically low energy and requires much less bits to encode. The AAC coder also employs intensity stereo coding in high frequency bands, where only the left channel is sent and the right channel is generated by multiplying the left spectral coefficient by a single scaling factor for a whole band. In our analysis, both joint (M/S) stereo and intensity stereo enables the rematrixing flag in the AC-3 coder.

The AAC joint stereo coding decisions are made for each scale factor band, i.e., for each scale factor band there is a flag that indicates whether joint/intensity stereo coding is used for this particular band. The AC-3 coder does not use scale factor bands. Instead there are predefined rematrixing bands for each coupling strategy of the AC-3 encoder. Typically, there are four rematrixing bands that span AC-3 channel 13 to 252.

The reference rematrixing procedure of the AC-3 encoder generates the sum and difference signals (L+R)/2 and (L−R)/2 respectively. The rematrixing is decided for each band if the energy of the sum/difference channels is less than the energy of the original left and right channels. The computation involves computing the energy of four channels each of size 1536 coefficients.

The optimized rematrixing algorithm proceeds as follows:

1) Map each AC-3 rematrixing band to the corresponding AAC scale factors band.
2) Let the AAC scale factor bands for a particular rematrixing band be $[N_1, N_2]$. Denote the number of bands that are encoded using jointstereo by M.
3) if $M > \delta (N_2 - N_1)$, then the corresponding AC-3 rematrixing band is rematrixed. Otherwise, the AC-3 standard procedure for rematrixing strategy is computed for this particular band. The parameter $\delta$ is set using training data and its typical value is 0.25.

Hence, the computation intensive procedure for rematrixing strategy is run only in the absence of the AAC joint stereo coding. Note that, a suboptimal procedure could base the rematrixing decision entirely on the joint stereo decisions and in this case one may not need to run the rematrixing strategy procedures. However, as one may not have control on the AAC encoder, the joint stereo encoding may be entirely disabled (especially at high bit rates), and this would automatically disable the rematrixing procedure in the simplified version, while the proposed optimized rematrixing strategy will always enable the standard rematrixing procedure in this case.

The Bit allocation procedure usually accounts for most of the complexity of the encoder due to its iterative nature. An optimized procedure for minimizing the number of bit allocation iterations in the AC-3 encoder by exploiting the bit allocation information in the AAC bitstream is described.

The basic idea of the bit allocation algorithm is to match the quantization distortion in specific bands in both the AAC and AC-3 coder using time/frequency mapping described herein above.

The AAC coder segments the spectrum to nonoverlapped scale factor bands. A single scale factor is transmitted per band. At the encoder, the k-th spectral coefficient of the i-th scale factor band $x_{k,i}$ is scaled down by the scale factor s(i) as, $$\tilde{x}_{k,i} = x_{k,i} \cdot 2^{\frac{-1}{4}(s(i)-100)}$$

Then the spectral coefficients are raised to fractional power and quantized as:

$$x_{k,i}^{(q)} = Q(\tilde{x}_{k,i}^{3/4}) = Q\left(\frac{x_{k,i}^{3/4}}{\Delta_i}\right)$$

where Q(.) is the scalar quantization function, and $\Delta_i = 2^{3\cdot(s(i)-100)/16}$. The quantization noise random variable is defined as:

$$\delta_{k,i} = x_{k,i}^{(q)} - \frac{x_{k,i}^{3/4}}{\Delta_i}$$

Note that $\delta_{k,i} \epsilon [-\Delta_i/2, \Delta_i 2]$. Under some general conditions they can be approximated by an uniform independent random variables, i.e., $E\{\delta_{k,i}\}=0$, and $E\{\delta_{k,i}^2\}=\Delta_i^2/12$. At the decoder, the spectral coefficients are computed as:

$$\hat{x}_{k,i} = x_{k,i}^{(q)^{4/3}} \cdot 2^{(s(i)-100)/4}$$

The overall quantization error $\epsilon_{k,i}$ is defined as:

$$\epsilon_{k,i} = \hat{x}_{k,i} - x_{k,i}$$

Now, there are two cases for $\epsilon_{k,i}$:

$$\text{if } x_{k,i} = 0, \text{ then} \quad 1)$$
$$E\{\varepsilon_{k,i}\} = 0$$
$$E\{\varepsilon_{k,i}^2\} = \frac{3}{11}\left(\frac{\Delta_i}{2}\right)^{\frac{8}{3}}$$

$$\text{if } x_{k,i} \neq 0, \text{ then} \quad 2)$$
$$E\{\varepsilon_{k,i}\} = \frac{1}{54} x_{k,i}^{-\frac{1}{2}} \Delta_i^2$$
$$E\{(\varepsilon_{k,i} - E\{\varepsilon_{k,i}\})^2\} = \frac{4}{27} x_{k,i}^{\frac{1}{2}} \Delta_i^2 - \frac{1}{54^2} \Delta_i^2 / x_{k,i}$$

The quantization distortion cannot be estimated for frequency bands with zero scale factors. Therefore these bands are not used in the algorithm.

In the AC-3 standard, each spectral coefficient $x_k$ is factored to a mantissa $m_k$ and a 5-bit exponent $e_k$ such that $x_k = m_k 2^{\wedge}\{-e_k\}$. If $L_k$ is the number of quantization levels, then the quantization error $\epsilon_k \epsilon [-2^{-ek}/L_k, 2^{-ek}/L_k]$ and the variance of the quantization noise is:

$$E\{\varepsilon_k^2\} = \frac{4^{-e_k}}{3L_k^2}$$

The objective of the reuse algorithm is to reduce the number of iterations required in this procedure by exploiting the bit allocation information in the AAC bitstream.

The basic idea of the reuse algorithm is to match the quantization distortions in the corresponding frequency bands in both AAC and AC-3 coders after compensating for the filter delay in the AAC synthesis filter bank and the AC-3 analysis filter bank. Exact matching of the distortion is not expected due to the difference in the psychoacoustic model and the number of channels. Rather, bounds on the AC-3 distortion are derived that are derived from the corresponding distortion in the AAC data. These bounds are used to limit the search space of snroffset parameter in the AC-3 bit allocation algorithm, which is described in details in the AC-3 standard, resulting in reducing the number of iterations.

The first step of the algorithm is to choose the frequency bands for comparison. A small fraction of bands is used for matching purposes. The optimized bit allocation algorithm is used only when both the AAC and the AC-3 coders use long blocks for the corresponding frames. The standard AC-3 bit allocation algorithm is used in case of short blocks in either coder, where the bands mapping becomes rather complicated. Note that the long blocks account for more than 90% of all frames in most audio signals.

The matching frequency bands are usually in the lower side of the spectrum where typically most of the energy is concentrated. However, the few bands next to DC are not used to mitigate the effect of high pass filtering that is usually employed in the encoder to enhance the signal perception. The typical number of the matching AC-3 bands is four bands (which correspond to 16 AAC bands) in the range of bands between 10-40. Assume that the matching AC-3 frequency bands are between $N_1$ and $N_2$ (i.e., the corresponding AAC bands are 4 $N_1$ and 4 $N_2$). Define a scaling factor $\lambda$ that scales the AAC distortion to the AC-3 distortion (where $\lambda$ is a function of the bit rates of both the AAC and AC-3, and it is computed offline using training sequences). The optimized bit allocation algorithm proceeds as follows:

1. Compute the AAC distortion of the bands between $4N_1$ and $4N_2$ as discussed earlier. Compute the maximum and minimum distortions $d_{max}$ and $d_{min}$.
2. Run the AC-3 bit allocation algorithm for the bands between $N_1$ and $N_2$. At each iteration, compute the average distortion of these bands. If the distortion is higher than $\lambda d_{max}$, then increase snroffset parameters and vice versa until convergence. Denote the final snroffset value by off1. Note that the computational complexity of this step is small as the bit allocation algorithm is run over a small number of bands (typically 4 bands) as opposed to 256 bands of the full bit allocation algorithm.
3. repeat the previous step for $\lambda d_{min}$ to compute off2.
4. Run the full AC-3 bit allocation algorithm with off1 and off2 as upper and lower bounds on snroffset value.
5. The above steps are performed only when both AAC and AC-3 coders use long window blocks. If either of them uses short window blocks then the standard bit allocation algorithm is used instead.

Note that, one may not explicitly incorporate the psychoacoustic model of the first coder. However, it is inherently reflected in the quantization step of the spectral coefficients. The overhead of the above algorithm includes the computation of the quantization distortion in both AAC and AC-3 coders. This is done using lookup tables on a small fraction of coefficients which adds small computational complexity. The algorithm significantly reduces the search span of snroffset values, therefore it reduces the number of iterations before convergence.

Figure 4:
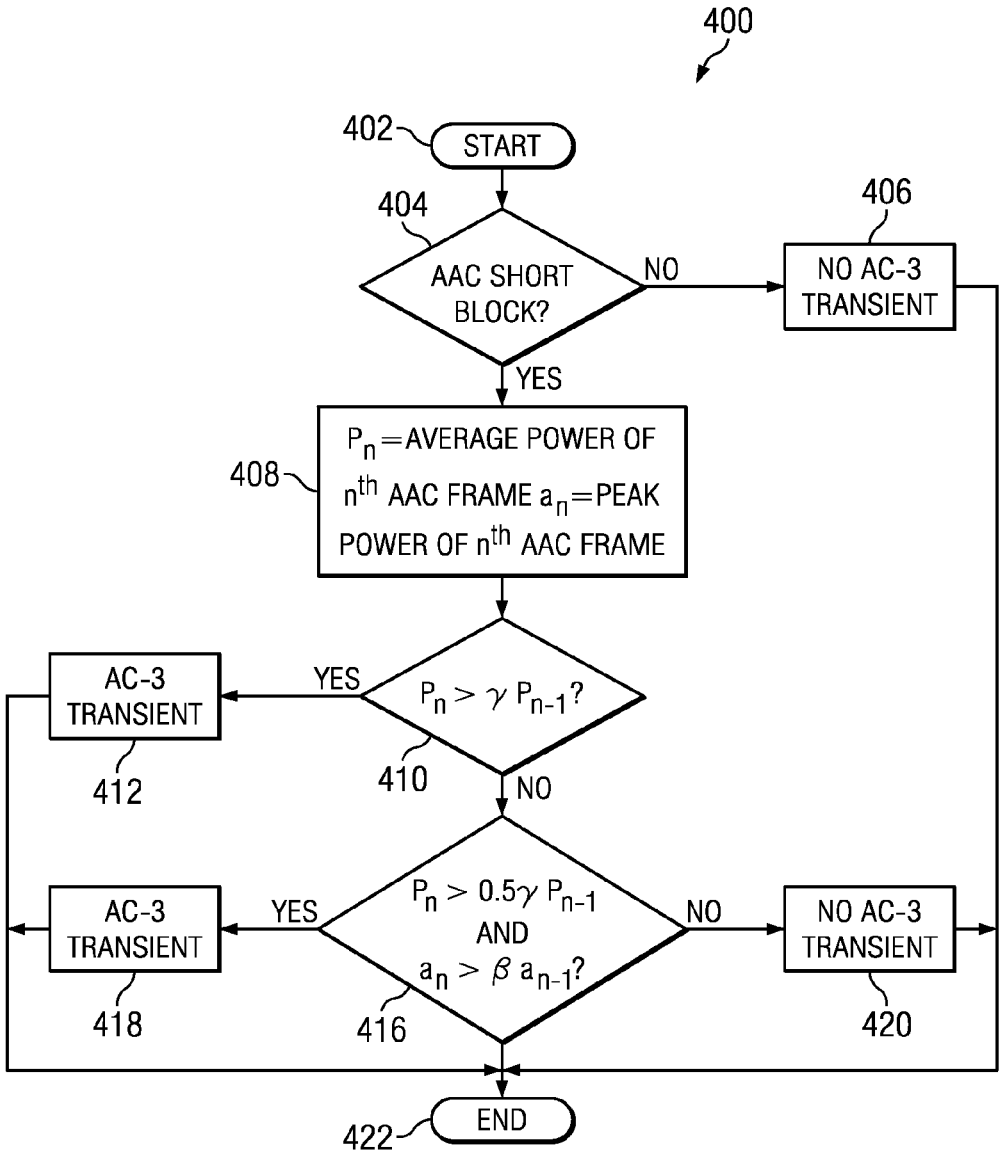
FIG. 4 is a flow diagram depicting an embodiment of a method for optimizing transient detector.

FIG. 4 is a flow diagram depicting an embodiment of a method 400 for optimizing transient detector. The method 400 starts at step 402 and proceeds to step 406. At step 406, the method 400 determines if there exists AAC short Block. If there is not an AAC short block, the method 400 proceeds to step 406. At step 406 the method 400 determines that there is no AC-3 transient and the method 400 proceeds to step 422. If there exists AAC short block, the method 400 proceeds to step 408. At step 408, the method 400 determines the average power and the peak power of the $n^{th}$ AAC frame. At step 410, the method determines if the average power of the $n^{th}$ AAC frame is greater than a threshold. If it is greater, then the method 400 determines that there exists an AC-3 transient and the method 400 proceeds to step 422. If the average power of the $n^{th}$ AAC frame is not greater than a threshold, then the method 400 proceeds to step 416. At step 416, the method 400 determines if the average power of the $n^{th}$ AAC frame is greater than half the threshold and that the peak power is greater than a threshold. If the answer is true, then the method 400 proceeds to step 418; otherwise, the method 400 proceeds to step 420. At step 418, the method 400 determines that there exists an AC-3 Transient. At step 420, the method 400 determines that AC-3 Transient does not exist. The method 400 proceeds from steps 418 and 420 to step 422. The method 400 end at step 422.

Figure 5:
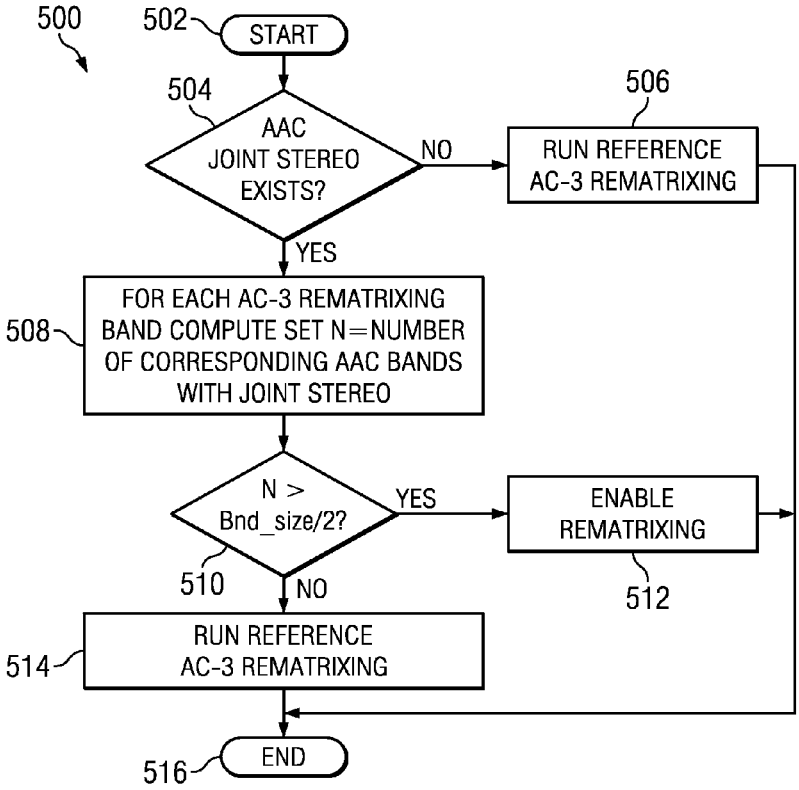
FIG. 5 is a flow diagram depicting an embodiment of a method for optimizing rematrixing.

FIG. 5 is a flow diagram depicting an embodiment of a method 500 for optimizing rematrixing. The method 500 starts at step 502 and proceeds to step 504. At step 504, the method 500 determines if AAC join stereo exists, for example, utilizing the method 400 of FIG. 4. If it does not exist, then the method proceeds to step 506; otherwise, the method proceeds to step 508. At step 506, the method 500 runs reference AC-3 rematrixing and the method 500 proceeds to step 516. At step 508, the method 500 determines the number of corresponding AAC band with joint stereo for each AC-3 rematrixing band. At step 510, the method 500 determines if the number is greater than half the size of the band. If it is greater, then the method 500 proceeds to step 512; otherwise, the method 500 proceeds to step 514. At step 512, the method 500 enables rematrixing. At step 514, the method 500 runs reference AC-3 rematrixing. From steps 512 and 514, the method 500 proceeds to step 516. The method 500 ends at step 516.

Figure 6:
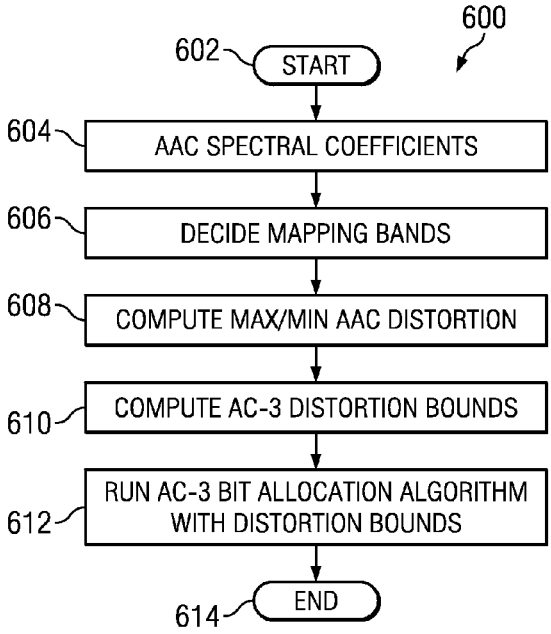
FIG. 6 is a flow diagram depicting an embodiment of a method for AC-3 bit allocation.

FIG. 6 is a flow diagram depicting an embodiment of a method 600 for AC-3 bit allocation. The method 600 starts at step 602 and proceeds to step 604. At step 604, the method 600 retrieves AAC spectral coefficients. At step 606, the method 600 decides on mapping bands utilizing AAC spectral coefficients and AAC bitstreams. At step 608, the method 600 computes the maximum and minimum AAC distortion bounds relating to the AAC bitstream. At step 610, the method 600 computes AC-3 distortion bound utilizing AC-3 spectral coefficients and the distortion bounds of the corresponding AAC bands. At step 612, the method 600 runs AC-3 bit allocation algorithm utilizing the computed distortion bounds and AC-3 spectral coefficients. The method 600 ends at step 614.

Thus, the proposed novel architecture for audio transcoding exploits the information available at the decoder to simplify the implementation of the various algorithms in the encoder. This optimization is possible because of the similarity between standard audio coders where similar decisions are made on the same data. Through studies, the similarity between the two systems (which is typical for other systems as well) and proposed efficient techniques simplify the encoder implementation. The proposed techniques may be adapted to other tanscoding schemes as well. The effectiveness of the proposed transcoder has been established using a large set of test audio files, which cause a significant reduction of the encoder complexity with no degradation in the audio quality.

The two audio coders of the proposed transcoder employ two different coding parameters and psychoacoustic models. If the two coders are similar, e.g., a bit-rate reduction system, then the overall transcoder could be significantly simplified. In this case, there is no need to convert the spectral coefficients to PCM samples, and the bitrate reduction can take place entirely in the spectral domain using a quantization-based technique similar to the discussed procedure. Moreover, the proposed transcoder could be simplified if the target coder is a superset of the source coder, e.g., in transcoding from MPEG-1 L2 to mp3 or from AAC to AAC-Plus.

While the foregoing is directed to embodiments of the present invention, other and further embodiments of the invention may be devised without departing from the basic scope thereof, and the scope thereof is determined by the claims that follow.

What is claimed is:

1. A method of an AC-3 audio encoder for transcoding audio data, the method comprising:

performing, by a processor, operations comprising:

parsing an AAC bitstream in order to determine whether an AAC joint stereo mode is enabled, wherein the AAC bitstream comprises data relating to AAC bands;

determining whether each band of the AAC bands has joint stereo and determining whether each band of the AAC bands is an AAC scale factor band;

when the AAC joint stereo mode is enabled and when the number of the AAC bands determined to have joint stereo is greater than half of the number of the AAC scale factor bands, enabling a rematrixing mode and rematrixing the AC-3 audio encoder; and when the AAC joint stereo mode is disabled and when the number of the AAC bands determined to have joint stereo is less than or equal to half the number of the AAC bands determined to be AC scale factor bands, performing reference AC-3 rematrixing in order to determine a status of the rematrixing mode.

2. The method of claim 1 further comprising at least one of:

generating at least one AC-3 spectral coefficient, using at least one AAC spectral coefficient;

matching, using at least one of time mapping and frequency mapping, a quantization distortion in a band generated by the AC-3 audio encoder; and reusing AAC transient information.

3. The method of claim 2, wherein the step of reusing the AAC transient information comprises:

determining, for an AAC frame, an average power and a peak power; and when the average power of the AAC frame is greater than a threshold or when the average power of the AAC frame is greater than half the threshold and the peak power is greater than a peak threshold, determining that there exists an AC-3 transient, otherwise, determining that AC-3 Transient does not exist.

4. The method of claim 2, wherein the step of matching comprises:

deciding, utilizing AAC spectral coefficients and AAC bitstreams, on mapping bands;

computing maximum and minimum AAC distortion bounds relating to the parsed AAC bitstream;

computing, utilizing AC-3 spectral coefficients, an AC-3 distortion bound; and running an AC-3 bit allocation algorithm utilizing the computed distortion bounds and the AC-3 spectral coefficients.

5. The method of claim 2, wherein the step for generating utilizes a hybrid filter bank of $$\Lambda = \begin{pmatrix} C_a & 0 & 0 & 0 \\ 0 & C_a & 0 & 0 \\ 0 & 0 & C_a & 0 \\ 0 & 0 & 0 & C_a \end{pmatrix} \cdot G \cdot C_s$$

wherein $C_a$ is a DCT-IV matrix of size 256, $C_s$ is the DCT-IV matrix of size 1024, and a block in G is size 128×128.

6. A transcoder, comprising:

means for performing operations, comprising:

means for parsing an AAC bitstream in order to determine whether an AAC joint stereo mode is enabled, wherein the AAC bitstream comprises data relating to AAC bands;

means for determining whether each band of the AAC bands has joint stereo and means for determining whether each band of the AAC bands is an AAC scale factor band;

when the AAC joint stereo mode is enabled and when the number of the AAC bands determined to have with joint stereo is greater than half of the number of the AAC scale factor bands, means for enabling a rematrixing mode and rematrixing the AC-3 audio encoder; and the when the AAC joint stereo mode is disabled and when the number of the AAC bands determined to have with joint stereo is less than or equal to half the number of the AAC bands determined to be AAC scale factor bands, means for performing reference AC-3 rematrixing in order to determine a status the rematrixing mode.

7. The transcoder of claim 6 further comprising at least one of:

means for generating at least one AC-3 spectral coefficient, using at least one AAC spectral coefficient;

means for matching, using at least one of time mapping and frequency mapping, a quantization distortion in a band generated by the AC-3 audio encoder; and means for reusing AAC transient information.

8. The transcoder of claim 7, wherein the means for reusing the AAC transient information comprises:

means for determining, for an AAC frame, an average power and a peak power; and means for determining that there exists an AC-3 transient when the average power is greater than a threshold; and means for determining that there is an AC-3 transient when the average power is greater than half the threshold and when the peak power is greater than a peak threshold; and means for determining that an AC-3 Transient does not exist when the average power is less than or equal to half the threshold and when the peak power is less than or equal to a peak threshold.

9. The transcoder of claim 6, wherein the means for matching comprises:

means for deciding, utilizing AAC spectral coefficients and AAC bitstreams, on mapping bands;

means for computing maximum and minimum AAC distortion bounds relating to the parsed AAC bitstream;

means for computing, utilizing AC-3 spectral coefficients, an AC-3 distortion bound; and means for running an AC-3 bit allocation algorithm utilizing the computed distortion bounds and the AC-3 spectral coefficients.

10. The method of claim 7, wherein the means for generating utilizes a hybrid filter bank of $$\Lambda = \begin{pmatrix} C_a & 0 & 0 & 0 \\ 0 & C_a & 0 & 0 \\ 0 & 0 & C_a & 0 \\ 0 & 0 & 0 & C_a \end{pmatrix} \cdot G \cdot C_s$$

wherein $C_a$ is a DCT-IV matrix of size 256, $C_s$ is the DCT-IV matrix of size 1024, and a block in G is size 128×128.

11. A non-transitory computer-readable storage medium with an executable program stored thereon, wherein the program, when executed, perform a method for transcoding audio data, the method comprising:

performing operations, comprising:

parsing an AAC bitstream in order to determine whether an AAC Joint stereo mode is enabled, wherein the AAC bitstream comprises data relating to AAC bands;

determining whether each band of the AAC bands has joint stereo and determining whether each band of the AAC bands is an AAC scale factor band;

when the AAC joint stereo mode is enabled and when the number of THE AAC bands determined to have with joint stereo is greater than half of the number of the AAC scale factor bands, enabling a rematrixing mode and rematrixing the AC-3 audio encoder; and when the AAC joint stereo mode is disabled and when the number of the AAC band determined to have with joint stereo is less than or equal to half the number of the AAC bands determined to be AAC scale factor bands, performing reference AC-3 rematrixing in order to determine a status of the rematrixing mode.

12. The non-transitory computer-storage medium of claim 11, further comprising at least one of:

generating at least one AC-3 spectral coefficient, using at least one AAC spectral coefficient;

matching, using at least one of time mapping and frequency mapping, a quantization distortion in a band generated by the AC-3 audio encoder; and reusing AAC transient information.

13. The non-transitory computer-readable storage medium of claim 12, wherein the step of reusing the AAC transient information comprises:

determining, for an AAC frame, an average power and a peak power; and when the average power of the AAC frame is greater than a threshold or when the average power of the AAC frame is greater than half the threshold and the peak power is greater than a peak threshold, determining that there exists an AC-3 transient, otherwise, determining that AC-3 Transient does not exist.

14. The non-transitory computer-readable storage medium of claim 11, wherein the step of matching the quantization distortion in a band in both an AAC and an AC-3 coder using time/frequency mapping comprises:

deciding, utilizing AAC spectral coefficients and AAC bitstreams, on mapping bands;

computing maximum and minimum AAC distortion bounds relating to the parsed AAC bitstream;

computing, utilizing AC-3 spectral coefficients, an AC-3 distortion bound; and running an AC-3 bit allocation algorithm utilizing the computed distortion bounds and the AC-3 spectral coefficients.

15. The non-transitory computer-readable storage medium of claim 12, wherein the step for generating utilizes a hybrid filter bank of $$\Lambda = \begin{pmatrix} C_a & 0 & 0 & 0 \\ 0 & C_a & 0 & 0 \\ 0 & 0 & C_a & 0 \\ 0 & 0 & 0 & C_a \end{pmatrix} \cdot G \cdot C_s$$

wherein $C_a$ is a DCT-IV matrix of size 256, $C_s$ is the DCT-IV matrix at size 1024, and a block in G is size 128×128.

* * * * *